US005992674A

United States Patent [19]

Schulz

[11] Patent Number: 5,992,674

[45] **Date of Patent: *Nov. 30, 1999**

[54] TRAY AND TWO PART COVER FOR EASY OPENING AND HANDLING

[75] Inventor: Werner Schulz, Horsens, Denmark

[73] Assignee: Danisco A/S, Denmark

[ * ] Notice: This patent issued on a continued prosecution application filed under 37 CFR 1.53(d), and is subject to the twenty year patent term provisions of 35 U.S.C. 154(a)(2).

[21] Appl. No.: 08/481,448

[22] PCT Filed: Dec. 16, 1993

[86] PCT No.: PCT/DK93/00423

§ 371 Date: Jun. 21, 1995

§ 102(e) Date: Jun. 21, 1995

[87] PCT Pub. No.: WO94/14677

PCT Pub. Date: Jul. 7, 1994

[30] Foreign Application Priority Data

Dec. 21, 1992 [DK] Denmark ..... 1524/92

[51] Int. Cl.[6] ..... B65D 17/34

[52] U.S. Cl. ..... 220/359.4; 229/123.1; 229/125.35; 426/123; 426/115; 426/396

[58] Field of Search ..... 229/125, 35, 123.1, 229/160.2, 125.33, 125.42, 247–249; 426/396, 122, 123, 115; 220/359.2–359.4

[56] References Cited

U.S. PATENT DOCUMENTS

| | | | |
|---|---|---|---|
| 1,320,757 | 11/1919 | Hothersall . | |
| 2,736,656 | 2/1956 | Marshall | 229/123.1 |
| 2,925,188 | 2/1960 | Grumbles | 426/115 |
| 2,986,322 | 5/1961 | Atkinson | 426/123 |
| 3,154,225 | 10/1964 | Wadlinger et al. | 229/125.35 |
| 3,166,234 | 1/1965 | Amberg | 229/160.2 |
| 3,235,165 | 2/1966 | Jackson | 229/123.1 |
| 3,381,884 | 5/1968 | Herrity | 229/123.1 |
| 3,547,338 | 12/1970 | Nemmes | 229/123.1 |
| 3,893,566 | 7/1975 | Ross | 229/125.35 |
| 3,942,676 | 3/1976 | Beckers | 229/125.35 |
| 3,977,562 | 8/1976 | Wedzik et al. . | |
| 3,997,677 | 12/1976 | Hirsch et al. . | |
| 4,141,487 | 2/1979 | Faust et al. . | |
| 4,453,666 | 6/1984 | Gordon . | |
| 4,673,085 | 6/1987 | Badouard et al. | 229/123.1 |
| 4,673,126 | 6/1987 | Hambleton . | |
| 4,771,935 | 9/1988 | Nekai | 229/123.1 |

FOREIGN PATENT DOCUMENTS

| | | | |
|---|---|---|---|
| 160702 | 4/1991 | Denmark . | |
| 0 007 971 | 2/1980 | European Pat. Off. . | |
| 0 093 442 | 11/1983 | European Pat. Off. . | |
| 305976 | 3/1989 | European Pat. Off. | 229/125.35 |
| 0 448 452 | 6/1992 | European Pat. Off. . | |
| 319186 | 11/1902 | France . | |
| 2 577 897 | 8/1986 | France . | |
| 21 40 733 | 2/1973 | Germany . | |
| 28 40 223 | 3/1979 | Germany . | |
| 563284 | 6/1975 | Switzerland | 229/160.2 |
| 1 404 471 | 7/1975 | United Kingdom . | |
| 2 169 261 | 7/1986 | United Kingdom . | |
| WO 86/03474 | 6/1986 | WIPO . | |

*Primary Examiner*—Steven Weinstein
*Attorney, Agent, or Firm*—Sterne, Kessler, Goldstein & Fox P.L.L.C.

[57] ABSTRACT

A container comprises a tray-shaped bottom part (1) with an opening covered by a cover part. The cover part is sealed to the bottom part along a circumferential rim (10) thereof to form a sealed compartment. The cover part comprises a first cover sheet (2) sealed to the bottom part (1) along a portion (11) of the rim (10) thereof, and a second cover sheet (3) peelably sealed to the first cover sheet (2) and to the bottom part (1) along the remaining portion (12) of the rim (10) thereof. The resulting container is easy to open and to handle without risk of spilling the contents thereof.

7 Claims, 2 Drawing Sheets

TRAY AND TWO PART COVER FOR EASY OPENING AND HANDLING

TECHNICAL FIELD

The invention relates to a container comprising a tray-shaped bottom part with an opening covered by a flexible cover part sealed to the bottom part along a circumferential rim thereof so as to form a sealed compartment. The cover part comprises a first cover sheet being sealed to the bottom part along a portion of the rim thereof, and a second cover sheet being peelably sealed to the first cover sheet and to the bottom part along the remaining portion of the rim thereof and having a gripping member extending beyond the sealing line with the bottom part or with the first cover sheet.

BACKGROUND ART

DE-B 2,140,733 discloses a container of the above type and adapted to contain ready-made dishes to be warmed up in boiling water of an oven, such as a microwave oven, said container comprising a tray-shaped bottom part of aluminium and a cover part of aluminium sealed to the bottom part along the rim thereof. Weakening lines divide the cover part into three portions, each portion being provided with a gripping member to be gripped when the portion in question of the cover part is to be removed from the bottom part.

Correspondingly, DK-B 160,702 discloses a container of the above type and comprising a tray-shaped bottom part and a peelable cover sheet of polyester. This container is also suited for freezing and storing articles of food and can be used later on in connection with the warming up of said article of food in an oven, such as a microwave oven.

Further, DE-A1 2,840,223 discloses a tobacco pouch of plastic sheet with an opening closed by means of a peelable closure strip.

Moreover, U.S. Pat. No. 1,320,757 discloses a sheet metal container of the type comprising a cover soldered to a lower part along lines of solder. The cover may be torn away along said lines to open the container. The cover comprises two cover sheets of metal soldered together along an obliquely extending line which intersects the side walls of the container at angles. Furthermore, each cover sheet soldered to the rim of the container wall. At a corner of the overlapping area between the two cover sheets each cover sheet is provided with a tongue, which may be gripped for removing the cover sheet in question. According to the publication, it is possible to remove the cover by hand without using a key. However, it should be considered very doubtful whether it will be possible to break the solder connection and thereby tear off the cover sheet without using tools, such as a key. Under all circumstances, tearing off the cover sheet without using a tool requires such a strength and is connected with such a risk of cutting oneself that very few persons would make the attempt at all.

Finally, FR-B1-319,186 discloses a sheet metal container essentially only differing from the container according to U.S. Pat. No. 1,320,757 in that a gripping ring is attached to the tongue for tearing off the cover sheet in question by hand.

U.S. Pat. No. 1,320,757 and FR-B1-319,186 thus relate to a completely different type of packing than the present invention.

BRIEF DESCRIPTION OF THE INVENTION

The object of the invention is to provide a container of the above type, which is particularly suited for storing and preparing articles of food, and which is easy to open without risk of spilling the contents thereof.

The container according to the invention is characterised in that the bottom part and the first and the second cover sheet are made of a laminate comprising a polymer, said bottom part having an inwardly facing laminate layer comprising PE, said first cover sheet having an inwardly facing laminate layer comprising PE, and an outwardly facing laminate layer comprising PP, and said second cover sheet having an inwardly facing laminate layer comprising PE.

As a result, the peelable cover sheet need only be removed in order to allow access to the interior of the container, said cover sheet preferably cove a small portion of the opening of the container. As the peelable sheet can be removed without risk of removing the entire cover part, the risk of some of the contents being spilled in connection with the opening is reduced compared to the known containers. In addition, as the first cover sheet remains on the tray, the entire container possesses an improved stability compared to the corresponding known containers after the opening.

According to the invention, the second cover sheet may be peelably sealed to the first cover sheet and the first cover sheet more strongly sealed to the bottom part. Theoretically speaking, the first cover sheet could also be peelably sealed to the bottom part. It is, however, preferred that the first cover sheet is relatively strongly sealed to the bottom part, or at least more strongly sealed thereto than the peelable sheet in such a manner that the risk of a portion of the first cover sheet being peeled off in connection with the opening of the container is minimized.

In addition, according to the invention, the second peelable cover sheet hand, the portion of the opening covered by the peelable sheet should be of such a size that it is possible to pour out the contents of the container.

Moreover according to the invention at least one cover sheet and preferably both cover sheets may comprise a polymer.

Finally according to the invention the bottom part may be made of a resilient material, which preferably comprises a polymer. Although it is preferred, of course, to use a relatively resilient or semi-rigid bottom part, it is obvious that a rigid bottom part can also be used.

BRIEF DESCRIPTION OF THE DRAWINGS

The invention is explained in greater detail below with reference to the accompanying drawing, in which.

BEST MODE FOR CARRYING OUT THE INVENTION

Figure 1:
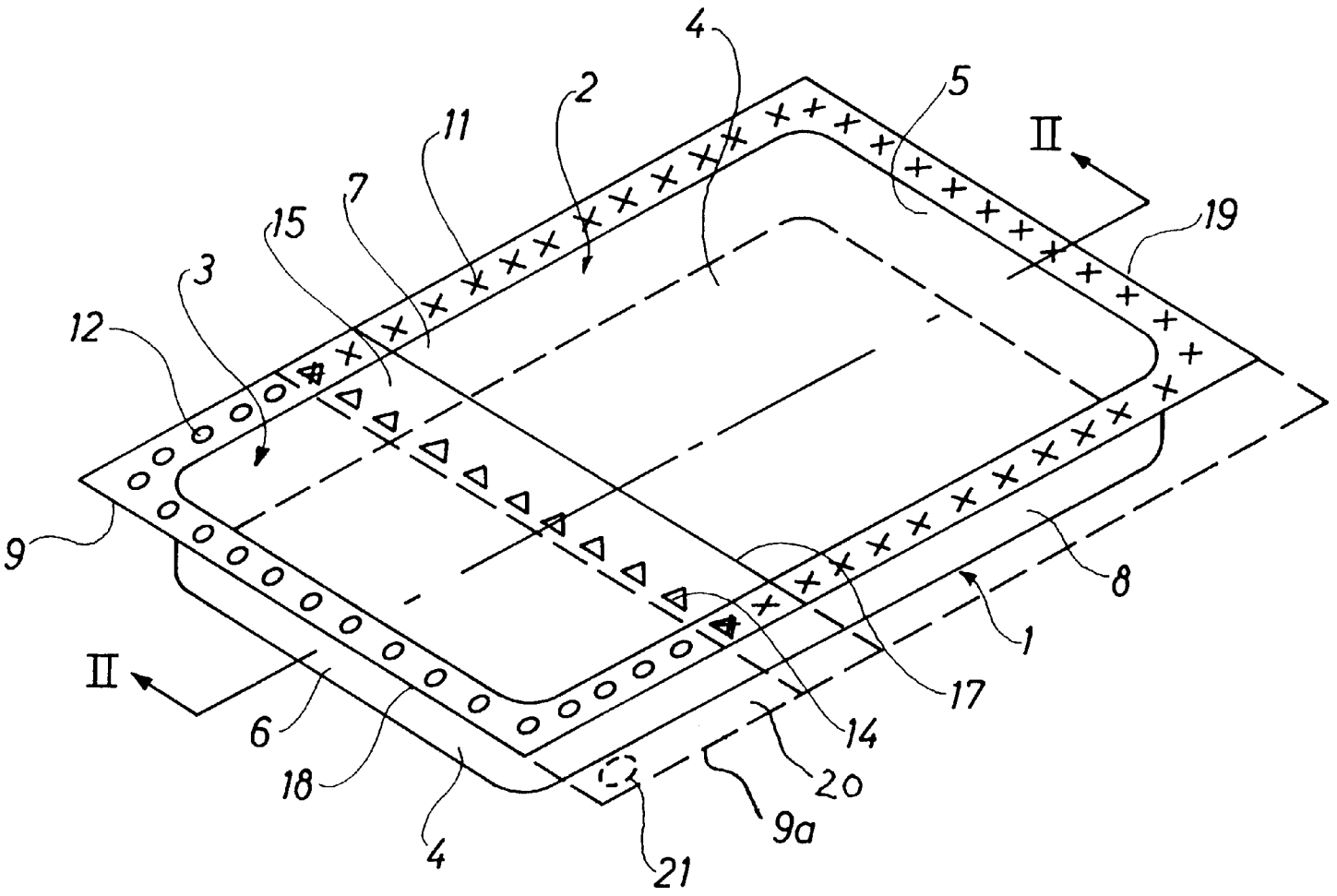
FIG. 1 is an isometric view of a preferred embodiment of a container according to the invention.
Figure 2:
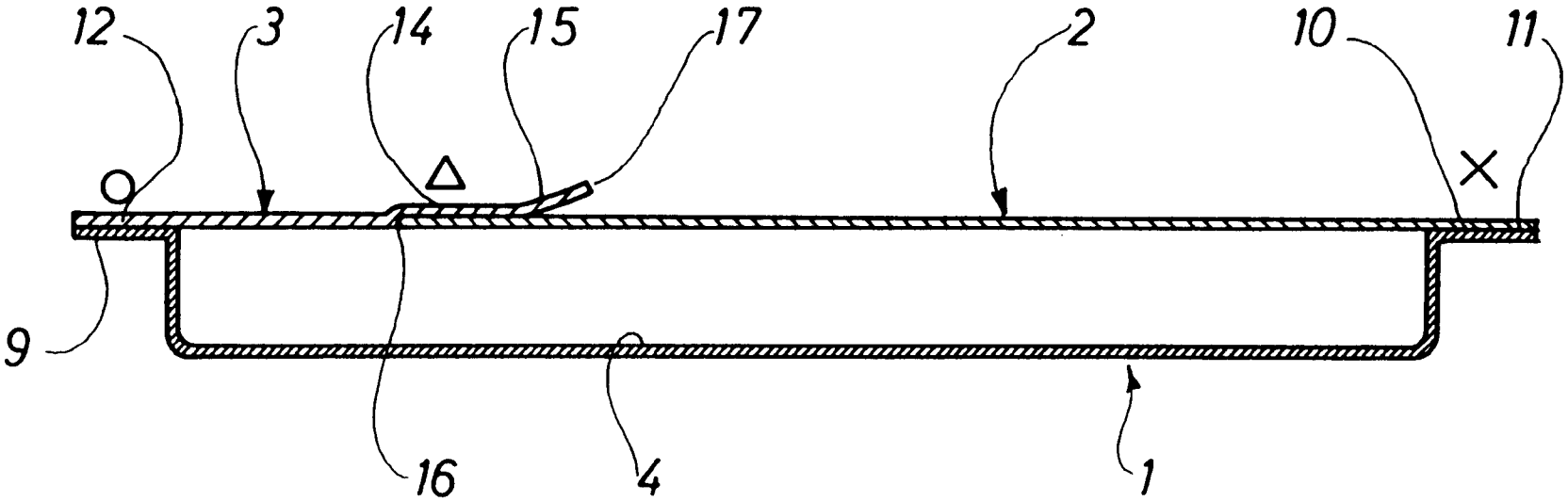
FIG. 2 is a sectional view taken along the lines II—II of FIG. 1.

The container comprises a tray-shaped bottom part 1 and a cover part 2, 3. The expression tray-shaped bottom part should be understood in the broadest sense as said bottom part can be substantially completely flat, i.e. without side walls, or it can be substantially deeper than shown in the Figure.

The bottom part 1 is rectangular and comprises a bottom 4. Two pairs of opposing side walls 5, 6 and 7, 8 extend upwards from the bottom 4 and continue at their upper end into a common flange 9, on which the upper rim 10 of the bottom part is positioned.

The cover part 2, 3 comprises a first cover sheet 2, which is relatively firmly sealed to the rim 10 of the bottom part 1 along the major portion 5 thereof by means of a first welding line 11 illustrated by means of x'es. The first cover sheet 2 covers the major portion of the opening of the tray-shaped bottom part 1. The cover part comprises furthermore a second cover sheet 3, which is peelably sealed to the remaining portion of the upper rim 10 of the bottom part 1 along a second welding line 12 indicated by means of o'es as well as to the first cover sheet 2 by means of a welding line 14 provided in the area at the free edge 16 of the first cover sheet 2 and indicated by means of triangles.

The second peelable cover sheet 3 extends in an overlapping manner a distance past the welding line 14 with the first cover sheet 2 to form a gripping strip 15 being gripped when the peelable cover sheet 3 is to be removed. Like the adjacent free edge 16 of the first cover sheet, the free edge 17 of the gripping strip 15 is parallel to the short side walls 5, 6 and the rims 18, 19 of the associated flange portions. In this manner both cover sheets 2, 3 are advantageously provided with parallel side edges.

In the-above embodiment, the peelable cover sheet 3 extends a distance past the welding line 14 with the first cover sheet 2 to form a gripping strip 15. A gripping strip 20 can, however, also or instead be provided by the peelable cover sheet 3 extending a distance past the welding line 12 with the upper rim 10 of the bottom part 1, cf. the dotted lines in the drawing. In this connection, the associated flange portion 9*a* can be formed with such a width that it is possible to grip said flange portion without touching the associated side wall 8 of the bottom part 1. The previously described embodiment can, of course, also advantageously be provided with such a broad flange portion.

Furthermore, an opening 21 can advantageously be provided in the broad flange portion of the flange 9. The insertion of a device, such as a tooth of a fork, into said opening renders it possible to remove the container from boiling water without the fingers coming in contact with said water. When the container comprises a further broad flange portion 9*a* which can be gripped without the associated side wall 8 being touched, it is possible to open the container without burning the fingers when the container and consequently the contents thereof are warmed up in boiling water.

The broad flange portion 9*a* can, of course, be provided according to desire at any or more of the three side walls 7, 8, and 6 associated with the peelable cover sheet 3.

The tray-shaped bottom part 1 can be made of any resilient, semi-rigid or rigid material. It is, however, for certain applications and for material-saving reasons preferred to use a resilient or semi-rigid laminate, such as a PE/PA/PE-laminate which has been deepdrawn into the desired shape and is of a thickness of 150 $\mu$m. It is preferred to use a relatively resilient material containing a polymer for the two cover sheets. Thus the first cover sheet 2 can be made of for instance PP/PE-laminate of a thickness of for instance 70 $\mu$m, the PE-layer facing inwards. The peelable cover sheet 3 can be made of for instance a PA/PE-laminate of substantially the same thickness as the first cover sheet, the PE-layer also facing inwards.

The strength of the sealings between the abutting surfaces can be controlled by means of a suitable material combination of the surfaces. The latter applies both to the composition of the material and to the application of a surface coating or the adhesive. The mutual sealing of the two cover sheets and the sealing thereof to the bottom part can be performed by any sealing method, such as by way of thermal sealing and ultrasonic sealing.

I claim:

1. A container comprising a substantially rectangular tray and a flexible cover, said tray comprising two pairs of opposing side walls and a bottom, defining a compartment, a circumferential rim along the top of said side walls, and an open top defined by said rim, said open top covered by said flexible cover which is scaled to said tray along the circumferential rim thereof to form a circumferential seal which seals the compartment, said cover comprising a first cover sheet, sealed by thermal sealing to said tray along a first portion of said circumferential seal at a portion of said circumferential rim thereof, and a second cover sheet, peelably sealed by thermal sealing to both said first cover sheet along a sealing line extending parallel to one of said side walls and inwardly of said circumferential seal and to said tray along the remaining portion of said circumferential seal, said second cover sheet extending past the sealing line to form an unsealed gripping strip with a free edge parallel to the sealing line, wherein said tray, said first cover sheet and said second cover sheet are made of a laminate comprising a polymer, said tray having an inwardly facing laminate layer comprising PE, said first cover sheet having an inwardly facing laminate layer comprising PE and an outwardly facing laminate layer comprising PP, and said second cover sheet having an inwardly facing laminate layer comprising PE.

2. A container as set forth in claim 1, wherein said second cover sheet is peelably sealed to said first cover sheet and wherein said first cover sheet is more strongly sealed to said tray.

3. A container as set forth in claim 1, wherein said first cover sheet covers at least 50% of the open top of said tray.

4. A container as set forth in claim 1, wherein said tray is made of resilient material.

5. A container as set forth in claim 1, wherein said second cover sheet extends outwardly beyond the circumferential seal to form a gripping member.

6. A container as set forth in claim 1, wherein said first cover sheet covers at least 75% of the open top of said tray.

7. A container as set forth in claim 1, wherein said first cover sheet covers at least 75 to 95% of the open top of said tray.

* * * * *

UNITED STATES PATENT AND TRADEMARK OFFICE

CERTIFICATE OF CORRECTION

PATENT NO. : 5,992,674

DATED : November 30, 1999

INVENTORS : Werner Schulz

It is certified that an error appears in the above-identified patent and that said Letters Patent is hereby corrected as shown below.

On the title page,

Item [56] , Foreign Patent Documents, delete "1,404,471" and insert therein --1,401,471--. column 1, line 20, delete "of" and insert therein --or--. claim 1, column 4, line 18, delete "scaled" and insert therein --sealed--.

Signed and Sealed this

Twelfth Day of December, 2000

*Attest:*

*Attesting Officer*

Q. TODD DICKINSON

*Director of Patents and Trademarks*